US009665032B2

(12) United States Patent
Shibuya

(10) Patent No.: US 9,665,032 B2
(45) Date of Patent: May 30, 2017

(54) IMAGE FORMING APPARATUS WITH EXPOSURE CONTROLLED IN DEPENDENCE ON CUMULATIVE OPERATING TIME AND HUMIDITY

(71) Applicant: CANON KABUSHIKI KAISHA, Tokyo (JP)

(72) Inventor: Kenichi Shibuya, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/057,301

(22) Filed: Mar. 1, 2016

(65) Prior Publication Data

US 2016/0179029 A1 Jun. 23, 2016

Related U.S. Application Data

(63) Continuation of application No. PCT/JP2014/075759, filed on Sep. 19, 2014.

(30) Foreign Application Priority Data

Sep. 19, 2013 (JP) ..... 2013-194649

(51) Int. Cl.
*G03G 15/04* (2006.01)
*G03G 15/043* (2006.01)
*G03G 15/00* (2006.01)

(52) U.S. Cl.
CPC ..... *G03G 15/043* (2013.01); *G03G 15/5033* (2013.01); *G03G 2215/00603* (2013.01)

(58) Field of Classification Search
USPC ..... 399/51
See application file for complete search history.

(56) References Cited

U.S. PATENT DOCUMENTS 4,827,306 A * 5/1989 Tsujimoto ..... G03G 21/08 399/128
8,260,163 B2 9/2012 Shibuya et al.
8,391,749 B2 * 3/2013 Inoue ..... G03G 21/08 399/128
8,417,134 B2 * 4/2013 Hosohara ..... G03G 21/181 399/110

(Continued)

FOREIGN PATENT DOCUMENTS

JP 04-093863 3/1992
JP 05-165387 7/1993

(Continued)

*Primary Examiner* — Quana M Grainger
(74) *Attorney, Agent, or Firm* — Fitzpatrick, Cella, Harper & Scinto

(57) ABSTRACT

An image forming apparatus capable of suppressing a charging lateral stripe liable to generate at a last stage of a lifetime of a photosensitive member while suppressing a density fluctuation is provided.

A constitution which includes a photosensitive member 1, a charging portion 2, a charging voltage source S1, an exposure portion 3, a developing portion 4, an obtaining portion 120 for obtaining information relating to a cumulative operating amount and a controller 110 for effecting control so that a discharging operation for discharging the photosensitive member 1 by exposing the photosensitive member 1 to light by the exposure portion 3 is executed is used.

4 Claims, 13 Drawing Sheets

(56) References Cited

U.S. PATENT DOCUMENTS

| | | | | |
|---|---|---|---|---|
| 2010/0239280 | A1 | 9/2010 | Inoue | |
| 2014/0016953 | A1* | 1/2014 | Yoshida | G03G 15/55 399/26 |
| 2014/0334835 | A1* | 11/2014 | Toyoizumi | B41J 2/471 399/51 |

FOREIGN PATENT DOCUMENTS

| | | | | |
|---|---|---|---|---|
| JP | 05341620 | A * | 12/1993 | 399/176 |
| JP | 2009-036829 | | 2/2009 | |
| JP | 2010-049190 | | 3/2010 | |
| JP | 2010-217627 | | 9/2010 | |

* cited by examiner

IMAGE FORMING APPARATUS WITH EXPOSURE CONTROLLED IN DEPENDENCE ON CUMULATIVE OPERATING TIME AND HUMIDITY

TECHNICAL FIELD

The present invention relates to an image forming apparatus, such as a copying machine, a printer or a facsimile machine, using an electrophotographic type.

BACKGROUND ART

Conventionally, as a type for electrically charging a surface of a photosensitive member in the image forming apparatus using the electrophotographic type, there is a contact charging type for subjecting the surface of the photosensitive member to a charging process by contacting a charging member, to which a voltage is applied, with the surface of the photosensitive member. For example, a charging device of the contact charging type using a charging roller which is a roller-shaped charging member has advantages such that a low voltage of a voltage source is realized and that an ozone generation amount is small.

As the contact charging type, further the following two types are well known. A first type is an "AC charging type" in which the photosensitive member is charged by applying a superposed voltage between a DC voltage and an AC voltage to the charging member. A second type is a "DC charging type" in which the photosensitive member is charged by applying only the DC voltage to the charging member.

In the "AC charging type", the AC voltage uniformizes charging non-uniformity, so that a surface potential of the photosensitive member can be converged to a predetermined potential. For that reason, the "AC charging type", can more uniformly charge the surface of the photosensitive member compared with the "DC charging type". On the other hand, the "AC charging type" increases in electric discharge amount to the photosensitive member compared with the "DC charging type", and therefore the surface of the photosensitive member is liable to abrade (wear). For that reason, when the photosensitive member is charged by the "AC charging type", compared with the case where the photosensitive member is charged by the "DC charging type", a lifetime of the photosensitive member becomes short in some cases. Further, in the "AC charging type", an AC voltage source is needed. For that reason, it has been known that the "DC charging type" is advantageous in terms of a running cost and an initial cost compared with the "AC charging type".

Further, conventionally, a pre-exposure means for removing residual electric charges on the surface of the photosensitive member after a toner image is transferred has been provided upstream of a charging portion of the charging device with respect to a surface movement direction of the photosensitive member. As the pre-exposure means, an LED chip array, a fuse lamp, a halogen lamp, a fluorescent lamp or the like is used. However, in the case where the above-described pre-exposure means is employed in an image forming apparatus employing the DC charging type in which the charging of the photosensitive member is effected by causing electric discharge under application of only the DC voltage to the charging roller as the charging portion, when for example a halftone image is formed, there if a problem such that a stripe-shaped density non-uniformity image (hereinafter also referred to as a "charging lateral stripe") generates with respect to a longitudinal direction (direction substantially perpendicular to a circumferential direction) of the photosensitive member due to non-uniformity in surface potential of the photosensitive member. FIG. 17 is a schematic view for illustrating a mechanism of generation of the charging lateral stripe. A photosensitive drum 1 which is a rotatable drum-type (cylindrical) photosensitive member and a charging roller 2 which is a roller-shaped charging member are disposed in contact with each other. The photosensitive drum 1 and the charging roller 2 rotates so that movement directions of the respective surfaces move in the same direction at a contact portion (charging nip) a. Of minute gaps between the photosensitive drum 1 and the charging roller 2, a gap on an upstream side with respect to the surface movement direction of the photosensitive drum 1 is an upstream gap C1, and a gap on a downstream side is a downstream gap C2. At this time, in the upstream gap C1, a potential difference between the photosensitive drum 1 and the charging roller 2 exceeds a discharge start threshold based on the Paschen's law and the electric discharge is made, so that electric charges are placed on the photosensitive drum 1 and the surface potential becomes a dark portion (potential (VD). If the electric discharge is uniformly made in this upstream gap C1, as shown in (a) of FIG. 17, uniform charging of the photosensitive drum 1 is completed in the upstream gap C1 is completed, so that an image defect such as the charging lateral stripe does not generate. However, in the case of a constitution in which discharging exposure by the pre-exposure is made, even when the electric discharge is made between the photosensitive drum 1 and the charging roller 2 in the upstream gap C1 and uniform charging is completed, a potential of the photosensitive member charged on the upstream side lowers by the influence of dark decay when the photosensitive drum 1 passes through the nip between the photosensitive drum 1 and the charging roller 2 where the electric discharge is not made, so that incomplete (non-uniform) minute electric discharge is made between the photosensitive drum 1 reached the downstream gap C2 and the downstream gap C2, and at that portion, the surface potential of the photosensitive drum 1 generates non-uniformity and thus the charging lateral stripe generates. Therefore, in order to suppress generation of the above-described charging lateral stripe due to an increase in dark decay of the photosensitive drum 1 resulting from the pre-exposure means, it is also required that image formation is effected without providing this pre-exposure means. In the image forming apparatus in which the pre-exposure means is not provided, there is no means for actively discharging the surface of the photosensitive member after a charging process is ended, so that a density fluctuation generates in some cases. A detailed mechanism is not clarified, but sensitivity of the photosensitive member to light is improved by continuation of a state in which the photosensitive member is charged without effecting the electric discharge and a light portion potential (VL) after the exposure becomes low by the exposure of the photosensitive member to light during image formation, with the result that it is assumed that an image density increases. This phenomenon is also called VL down.

On the other hand, a method in which during a post-rotation operation after an image forming process is ended, a surface of a photosensitive member is exposed to light through one full circumference or more of the photosensitive member to effect electric discharge using an exposure device which is an exposure means (image exposure means) for forming an image by exposure the photosensitive member to light has been known (Japanese Laid-Open Patent Application Hei 4-93863).

SUMMARY OF THE INVENTION

Problem to be Solved by the Invention

However, by a study of the present inventor, in the case where the photosensitive member is exposed to light at certain exposure amount in order that the photosensitive member is intended to be discharge to certain surface potential value by the method described in Japanese Laid-Open Patent application Hei 4-93863, it was turned out that at a final stage of a lifetime of the photosensitive member, the charging lateral stripe is liable to generate earlier than a predetermined lifetime of the photosensitive member. This would be considered due to a continuation of a state in which the photosensitive member is excessively discharged (charge-removed) as described later specifically. On the other hand, when the discharging of the photosensitive member is excessively made small (in frequency) in order to meet this, in the case where an image is outputted, for example, continuously in a large amount in one day, a density fluctuation due to an increase in the number of image-outputted sheets becomes large to an extent of an allowable range or more in some instances. This would be considered due to the above-described short-period density fluctuation (VL down).

Accordingly, an object of the present invention is to provide an image forming apparatus capable of suppressing generation of a charging lateral stripe at a final stage of the lifetime of the photosensitive member while suppressing the density fluctuation in a constitution in which the surface of the photosensitive member is exposed to light using an exposure portion for forming the image during the post rotation operation.

Means for Solving the Problem

According to an aspect of the present invention, there is provided an image forming apparatus comprising: a rotatable photosensitive member; a charging portion, rotatably contacting the photosensitive member, for electrically charging the photosensitive member by electric discharge under application of a DC voltage; a charging voltage source for applying the DC voltage to the charging portion; an exposure portion for exposing the photosensitive member charged by the charging portion to light to form an electrostatic image on a surface of the photosensitive member; a developing portion for developing, with a toner, the electrostatic image formed on the surface of the photosensitive member by the exposure portion to form a toner image on the surface of the photosensitive member; a transfer device for transferring the toner image formed on the surface of the photosensitive member onto a transfer material at a transfer portion, wherein image formation is effected without the exposure of the photosensitive drum to light in a position downstream of the transfer portion and upstream of the charging portion with respect to a rotational direction of the photosensitive member; an obtaining portion for obtaining information relating to a cumulative operating time; and a controller for effecting control so that the surface of the photosensitive member is exposed to light by the exposure portion over not less than one full turn of the photosensitive member during post-rotation after completion of formation of a final electrostatic image and before stop of rotation of the photosensitive member in a period of successive rotation of the photosensitive member, on the basis of the information obtained by the obtaining portion, wherein the controller effects control so that when the cumulative operating time of the photosensitive member obtained by the obtaining portion is a first time, an exposure amount of the photosensitive member by the exposure portion is a first exposure amount during the post-rotation, and when the cumulative operating time of the photosensitive member obtained by the obtaining portion is a second time longer than the first time, the exposure amount is a second exposure amount larger than the first exposure amount.

Effect of the Invention

According to the present invention, while suppressing the density fluctuation, it is possible to suppress the charging lateral stripe which is liable to generate at the final stage of the lifetime of the photosensitive member.

EMBODIMENTS FOR CARRYING OUT THE INVENTION

In the following, an image forming apparatus according to the present invention will be described further specifically with reference to the drawings.

[Embodiment 1]

1. General Structure and Operation of Image Forming Apparatus

Figure 1:
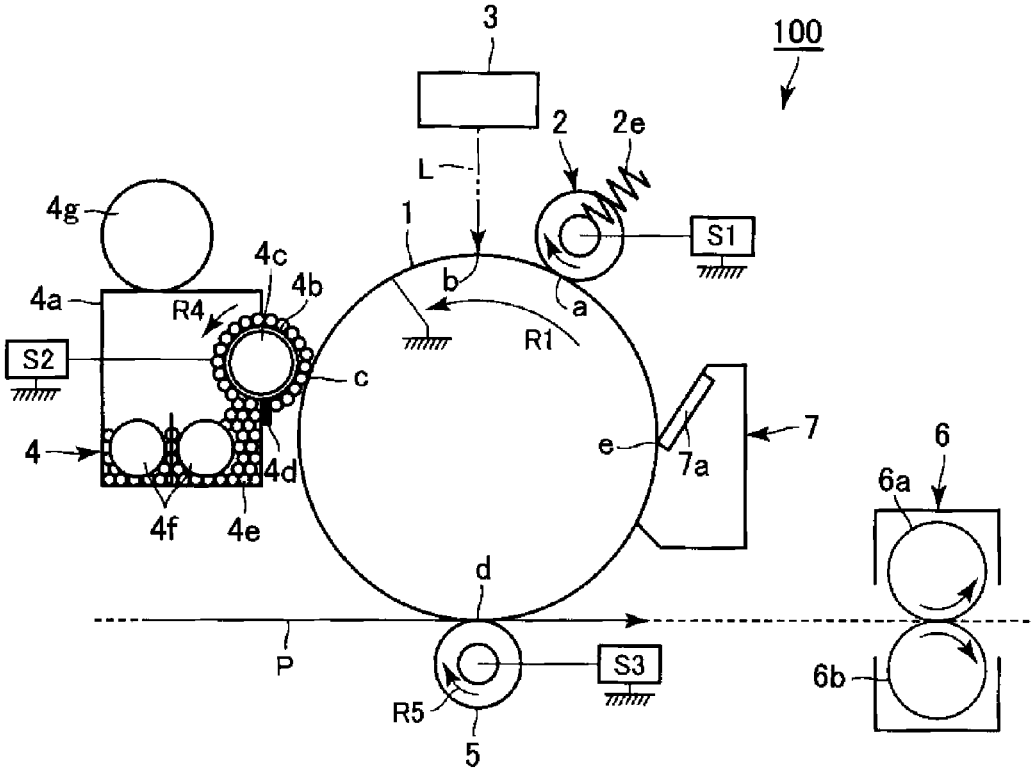
FIG. 1 is a schematic sectional view of an image forming apparatus according to an embodiment of the present invention.

FIG. 1 is a schematic longitudinal sectional view of an image forming apparatus 100 in this embodiment according to the present invention. The image forming apparatus 100 in this embodiment is a laser beam printer in which an image is formed by a contact charging type, a reverse development type, and a transfer type and in which a maximum sheet passing size is an A3 size.

The image forming apparatus 100 includes a photosensitive drum 1 which is a rotatable drum-shaped (cylindrical) electrophotographic photosensitive member as an image bearing member. The photosensitive drum 1 is rotationally driven in an arrow A direction (counterclockwise) in the figure. At a periphery of the photosensitive drum 1, along a rotational direction of the photosensitive drum 1, the following means are provided successively. First, a charging roller (roller charger) 2 which is a roller-shaped charging member (contact charging member) as a charging portion is disposed. Next, an exposure device 3 as an exposure portion (image exposure means) is disposed. Next, a developing device 4 as a developing portion is disposed. Next, a transfer roller 5 which is a roller-shaped transfer member (contact transfer member) as a transfer device. Next, a cleaning device 7 as a cleaning means is disposed. Incidentally, the exposure device 3 is provided above in the figure between the charging roller 2 and the developing device 4. Further, the image forming apparatus 100 includes a feeding means (not shown) for feeding a transfer material P as a transfer medium to a transfer portion d formed between the photosensitive drum 1 and the transfer roller 5, a fixing device 6 as a fixing means provided on a downstream side of the transfer portion d with respect to a feeding direction of the transfer material P, and the like.

Figure 2:
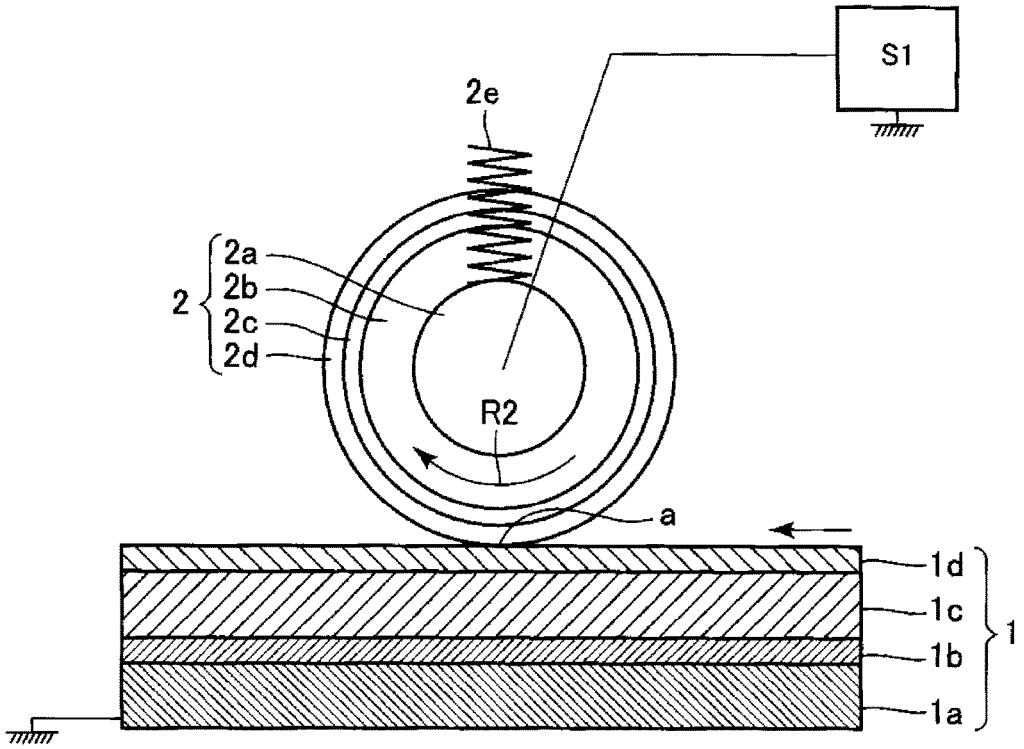
FIG. 2 is a schematic sectional view for illustrating layer structure of a photosensitive drum and a charging roller of the image forming apparatus according to the embodiment of the present invention.

FIG. 2 is a schematic sectional view more specifically showing constitutions of the photosensitive drum 1 and the charging roller 2.

The photosensitive drum 1 is a negatively chargeable organic photoconductor (OPC). An outer diameter of the photosensitive drum 1 is 30 mm. The photosensitive drum 1 is rotationally driven at a process speed (peripheral speed) of 200 mm/sec in general in an arrow R1 direction (counterclockwise) in FIG. 1 by a driving motor (main motor) as a during means (not shown). The photosensitive drum 1 is constituted, as shown in FIG. 2, by applying, onto an outer peripheral surface of an aluminum cylinder (electroconductive drum support) 1*a*, three layers consisting of an undercoat layer 1*b* for suppressing interference with light and for improving an adhesive property with an upper layer, a photo-charge generating layer 1*c* and a charge transporting layer 1*d* in this order.

The charging roller 2 is, as shown in FIG. 2, rotatably held by shaft-supporting (bearing) members (not shown) at both end portions of its core metal (core material) 2*a* with respect to a longitudinal direction (rotational axis direction). The charging roller 2 is urged toward a center direction of the photosensitive drum 1 by an urging spring 2*e* as an urging means at both end portions thereof. As a result, the charging roller 2 is press-contacted to the surface of the photosensitive drum 1 with a predetermined urging force, and is rotationally driven by rotation of the photosensitive drum 1. A press-contact portion between the photosensitive drum 1 and the charging roller 2 is a charging nip a.

The charging process of the surface of the photosensitive drum 1 as a portion-to-be-charged is made by the electric discharge from the charging roller 2 to the photosensitive drum 1. For that reason, the charging of the photosensitive drum 1 is started by applying a voltage of a certain threshold voltage or more to the charging roller 2. In this embodiment, when a DC voltage of about −600 V or more is applied to the charging roller 2, a surface potential of the photosensitive drum 1 starts to increase, and thereafter linearly increases with a slope of 1 relative to an applied voltage. For example, in order to obtain the surface potential of −300 V, the DC voltage of −900 V may only be required to be applied, and in order to obtain the surface potential of −500 V, the DC voltage of −1100 V may only be required to be applied. This threshold voltage is defined as a discharge start voltage (charge start voltage) Vth. That is, in order to obtain the dark portion potential VD which is the surface potential of the photosensitive drum 1 required for the electrophotographic process, to the charging roller 2, there is a need to apply a direct-current voltage (DC voltage) of not less than a required dark portion potential VD, such as VD+Vth.

To the core metal 2*a* of the charging roller 2, from a charging voltage source S1 as a charging bias applying means, a charging bias is applied under a predetermined condition. As a result, the peripheral surface the photosensitive drum 1 is electrically charged to a predetermined polarity (negative in this embodiment) and a predetermined potential. In this embodiment, during image formation, in order that the peripheral surface of the photosensitive drum 1 is substantially uniformly charged to the dark portion potential VD=−500 V, as the charging bias, the DC voltage of −1100 V is applied from the charging voltage source S1 to the charging roller 2 (DC charging type).

The charging roller 2 has a length of 320 mm with respect to its longitudinal direction. As shown in FIG. 2, the charging roller 2 has, on an outer peripheral surface of the core metal (supporting member) 2*a*, three layers consisting of a lower layer 2*b*, an intermediary layer 2*c*, and a surface layer 2*d* are successively laminated from below. The lower layer 2*b* is a foam sponge layer for decreasing charging noise. The surface layer 2*d* is a protective layer provided for preventing an occurrence of leakage even when a pin hole generates on the photosensitive drum 1. More specifically, the charging roller 2 in this embodiment has the following specification.

Core metal 2*a* : stainless steel rod with a diameter of 6 mm

Lower layer 2*b:* carbon-dispersed foam EPDM (specific gravity: 0.5 g/cm$^3$, volume resistivity: $10^2$-$10^9$ ohm.cm, layer thickness: 3.0 mm)

Intermediary layer 2*c:* carbon-dispersed NBR rubber (volume resistivity: $10^2$-$10^5$ ohm.cm, layer thickness: 700 μm)

Surface layer 2*d:* fluorinated "Torejin" resin in which tin oxide and carbon particles are disposed (volume resistivity: $10^7$-$10^{10}$ ohm.cm, surface roughness (JIS ten-point average surface roughness Ra): 1.5 μm, layer thickness: 10 μm)

As the exposure means 3 which is an exposure portion, a laser beam scanner including a semiconductor laser was used. The laser beam scanner outputs laser light (beam) L modulated correspondingly to an image signal inputted from an image reading device (not shown). The laser beam scanner subjects the substantially uniformly charged surface of the photosensitive drum 1 to scanning exposure (image exposure) to the light L at an exposure portion b. By this, an absolute value of the potential of the surface of the photosensitive drum 1 at a portion which has been irradiated with the laser light L lowers, so that an electrostatic latent image (electrostatic image) corresponding to the image information is formed on the surface of the photosensitive drum 1. For example, the dark portion potential VD of the photosensitive drum 1 is −500 V, and the light portion potential VL which is the surface potential at an exposed portion of the photosensitive drum 1 is −150 V. In this embodiment, a maximum light quantity of the exposure means 3 was 8 mW.

The developing device 4 as the developing portion is a developing device of a two-component magnetic brush developing type. The developing device 4 deposits the toner charged to a charge polarity (negative in this embodiment) of the photosensitive drum 1 on the exposed portion (light portion) of the surface of the photosensitive drum 1 and reversely develops the electrostatic latent image, so that the toner image is formed on the surface of the photosensitive drum 1. The developing device 4 includes a developing container 4*a* in which a two-component developer 4*e* which is a mixture of principally non-magnetic toner particles (toner) and magnetic carrier particles (carrier) is accommodated as the developer. At an opening of the developing container 4*a* provided at an opposing portion to the photosensitive drum 1, a developing sleeve 4*b*, as a developer carrying member, incorporating a fixed magnet roller 4*c* as a magnetic field generating means and being constituted by a non-magnetic material is rotatably provided. The developer 4*e* accommodated in the developing container 4*a* is constrained on the developing sleeve 4*b* by a magnetic force of the magnet roller 4*c* and is coated on the developing sleeve 4*b* in a thin layer. Then, the developer 4*e* is fed by rotation of the developing sleeve 4*b* to a developing portion c where the photosensitive drum 1 and the developing sleeve 4*b* oppose each other. The developer 4*e* in the developing container 4*a* is fed toward the developing sleeve 4*b* while being stirred substantially uniformly by rotation of two developer-stirring members 4*f*.

In this embodiment, the carrier has a volume resistivity of about $10^{13}$ ohm.cm and a particle size of 40 μm, and the toner is triboelectrically charged to a negative polarity by friction with the carrier. The toner content (concentration) of the developer 4*e* in the toner container 4*a* is detected by a concentration (density) sensor (not shown). On the basis of this detected information, the toner is supplied in an appropriate amount from a toner hopper 4*g* to the developing container 4*a*, so that the toner content of the developer 4*e* in the developing container 4*a* is adjusted to a substantially constant level. At the developing portion c, the closest distance of the developing sleeve 4*b* to the photosensitive drum 1 is kept at 300 μm, and the developing sleeve 4*b* is disposed opposed to the photosensitive drum 1. The developing sleeve 4*b* is rotationally driven in a direction (counterclockwise) indicated by an arrow R4 in FIG. 1 so that surface movement directions of the photosensitive drum 1 and the developing sleeve 4*b* are opposite devices at the developing portion c. To the developing sleeve 4*b*, a developing bias is applied from a developing voltage source S2 as a developing bias applying means under a predetermined condition. In this embodiment, as the developing bias, an oscillating voltage in the form of a DC voltage (Vdc) biased with an AC voltage (Vac) is applied from the developing voltage source S2 to the developing sleeve 4*b*. More specifically, in this embodiment, as the developing bias, the oscillating voltage in the form of the DC voltage (−320 V) biased with the AC voltage having a frequency of 8 kHz and a peak-to-peak voltage of 1800 Vpp is applied.

The transfer roller 5 as the transfer device is contacted to the photosensitive drum 1 with a predetermined urging force, and a transfer portion d is formed at a contact portion between the photosensitive drum 1 and the transfer roller 5. To the transfer roller 5, from a transfer voltage source S3 as a transfer bias applying means, a transfer bias is applied under a predetermined condition. In this embodiment, as a transfer bias which is a DC voltage of +500 V of an opposite polarity (positive in this embodiment) to the charge polarity (normal charge polarity) of the toner during development is applied from the transfer voltage source S3 to the transfer roller 5. The toner image on the photosensitive drum 1 is transferred onto the transfer material P such as a recording sheet (paper) at the transfer portion d.

The fixing device 6 includes a rotatable fixing roller 6*a* and a rotatable pressing roller 6*b*. The fixing device 6 fixes the toner image on the transfer material P under heat and pressure application while sandwiching and feeding the transfer material P at a fixing nip between the fixing roller 6*a* and the pressing roller 6*b*. Rotatable speeds of the fixing roller 6*a* and the pressing roller 6*b* are changeable depending on a material, a thickness and a basis weight of the transfer material P.

The cleaning device 7 removes and collects the toner (transfer residual toner), remaining on the surface of the photosensitive drum 1 after the transfer of the toner image onto the transfer material P, from the surface of the photosensitive drum 1. The cleaning device 7 rubs the surface of the rotating photosensitive drum 1 with a cleaning blade 7*a* contacting the photosensitive drum 1. By this, the surface of the photosensitive drum 1 is cleaned by being subjected to removal of the transfer residual toner, and is repetitively subjected to the image formation. A contact portion between the cleaning blade 7*a* and the surface of the photosensitive drum 1 is a cleaning portion e.

Figure 3:
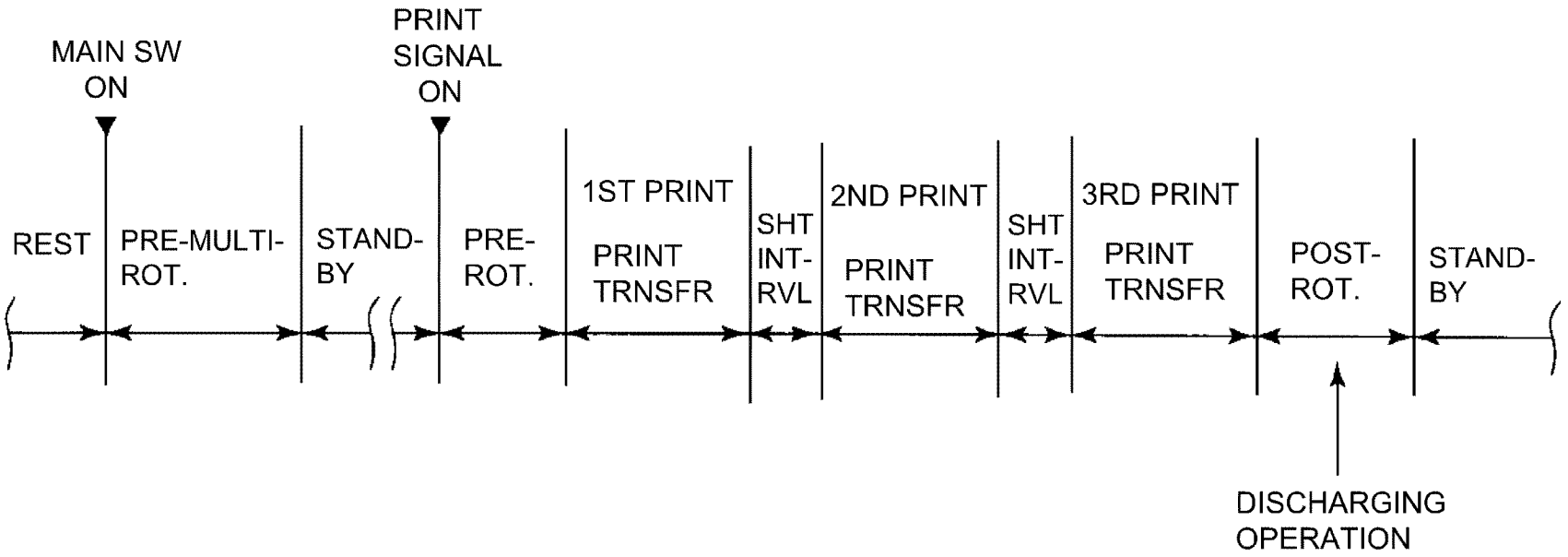
FIG. 3 is a chart for illustrating an operation sequence of the image forming apparatus according to the embodiment of the present invention.

FIG. 3 is a chart showing an operation sequence of the image forming apparatus 100 in this embodiment.

a. Initial Rotation Operation (Pre-multi-rotation Step)

This period is a period in which a starting operation (actuation operation, warming operation) during actuation of the image forming apparatus 100 is performed. The rotational drive of the photosensitive drum 1 is started by turning on a power source switch, and a preparatory operation of a predetermined process device, such as rising of the fixing device 6 to a predetermined temperature is executed.

b. Print-preparatory Rotation Operation (Pre-rotation Step)

This period is a period from turning-on of a print signal (an image formation start signal) until an image forming step (printing step) is actually started, in which the preparatory operation before the image formation is performed. When the print signal is inputted during the initial rotation operation, the operation is executed subsequently to the initial rotation operation. When there is no input of the print signal during the initial rotation operation, the drive of a main motor is once stopped after the end of the initial rotation operation and the rotational drive of the photosensitive drum 1 is stopped, so that the image forming apparatus 100 is maintained in a stand-by state (stand-by) until a (subsequent) print signal is inputted. Then, when the print signal is inputted, the print-preparatory rotation operation is executed.

In this embodiment, during this print-preparatory rotation operation, an adjusting step described later is performed. This adjusting step will be described later in detail.

c. Printing Step (Image Forming Operation)

When a predetermined print-preparatory rotation operation is ended, subsequently an image forming process on the photosensitive drum 1 is executed, so that the transfer of the toner image formed on the surface of the photosensitive drum 1 onto the transfer material P, the fixing process of the toner image by the fixing device 6, and the like are made and thus an image-formed product is printed out. In the case of an operation in a continuous printing (continuous print) mode, the above-described printing step is repetitively executed correspondingly to a predetermined set print number n.

d. Sheet-interval Step

This period is a period corresponding to a non-passing state of the transfer material P at the transfer portion d, from after passing of a trailing end of a transfer material P through the transfer portion d until a leading end of a subsequent transfer material P reaches the transfer portion d.

e. Post-rotation Operation

A post-rotation step is performed is a period in which the photosensitive drum 1 is rotationally driven by continuing the drive of the main motor for some time even after the printing step for a final transfer material P is ended, and thus a predetermined post-operation is executed.

In this embodiment, during this post-rotation operation, correspondingly to one full circumference of the photosensitive drum 1, the photosensitive drum 1 is irradiated with the light by the exposure device 3 as the exposure portion, so that a step of discharging (removing) residual electric charges on the photosensitive drum 1 (hereinafter referred to as "post-rotation discharging") is performed. In this post-rotation discharging, as described above, the surface potential of the photosensitive drum 1 after the discharging is not made 0 substantially completely, but is set so as to suppress the discharging (level) to a potential properly low in absolute value. That is, during the discharging operation, the photosensitive drum 1 is discharged (charge-removed) to a potential higher than 0 on its charge polarity side, i.e., so as to be a potential of the same polarity as the charge polarity of the photosensitive drum 1. Further, in this embodiment, during the above-described print-preparatory rotation operation, an adjusting step of adjusting a light quantity of the exposure device 3 in this post-rotation discharging (hereinafter referred to as "discharging exposure amount" or "exposure amount") is performed. Incidentally, in the post-rotation discharging, the photosensitive drum 1 is exposed to light by the exposure device 3 correspondingly at least one full circumference of the photosensitive drum 1, so that a desired surface potential of the photosensitive drum 1 after the discharging may only be required to be obtained, and the exposure to light may also be made over one full circumference or more. Further, in the exposure to light in the post-rotation discharging, of the peripheral surface of the photosensitive member, the exposure to light is made over an entire surface of the region where the electrostatic image is formed by the exposure device 3 during the image formation. The exposure amount refers to an exposure amount per unit area of the surface of the photosensitive drum 1 as the photosensitive member to light by the exposure device 3. By effecting the discharging exposure to light during the post-rotation discharging, it is possible to suppress generation of a state in which the charge potential remains on the photosensitive drum 1 after the image formation, and there is no printing step immediately after such as the pre-rotation step and therefore it is possible to suppress a lowering in productivity.

f. Stand-by Step

When the predetermined post-rotation operation is ended, the drive of the main motor is stopped and thus the rotational drive of the photosensitive drum 1 is stopped, so that the image forming apparatus 100 is maintained in a stand-by state until a subsequent print signal is inputted. In the case of printing of a single sheet, after the end of the printing, the image forming apparatus 100 is in the stand-by state through the post-rotation operation. In the stand-by state, when the print signal is inputted, the operation of the image forming apparatus 100 shifts to the print-preparatory rotation operation.

During the printing step c described above is during image the formation, and the initial rotation operation a, the print-preparatory operation b, the sheet-interval step d and the post-rotation operation e which are described above are during non-image formation. Further, the above-described post-rotation operation e corresponds to a step after the end of the image formation.

2. Adjusting Step

Next, the adjusting step of the light quantity (discharging exposure amount) of the exposure device 3 during the post-rotation discharging will be described.

Figure 4:
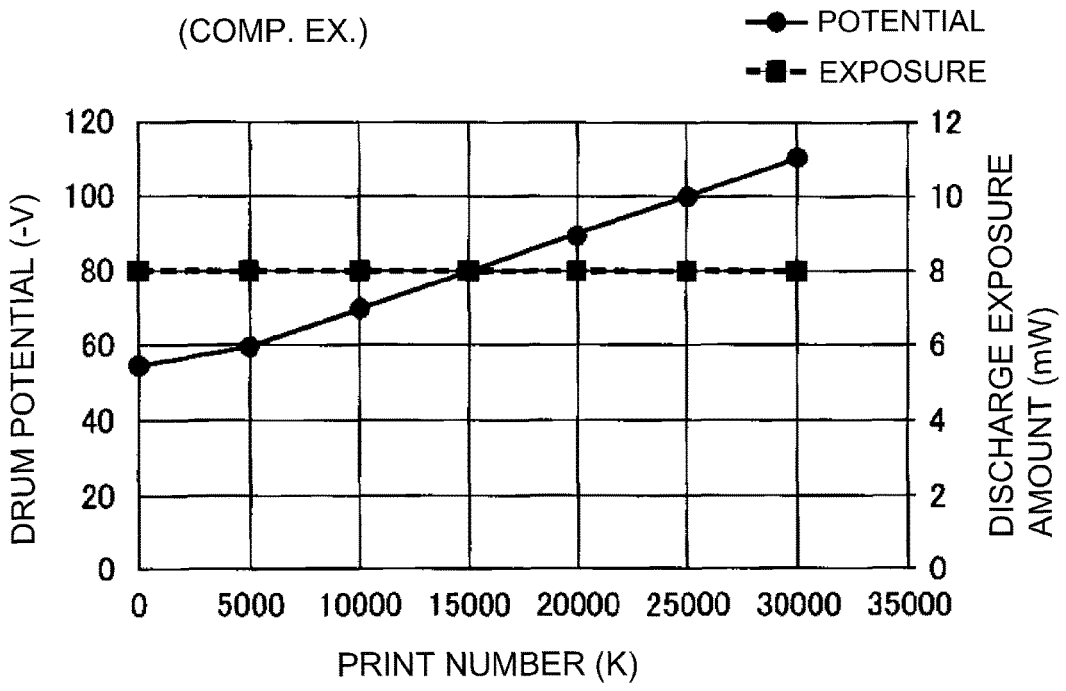
FIG. 4 is a graph showing a relationship between a durable sheet number and each of a surface potential and a discharging exposure amount of the photosensitive drum after post-rotation discharging in the case where the discharging exposure amount during the post-rotation discharging is constant (Comparison Example).

FIG. 4 shows a relationship between an operating amount (amount of use) of the photosensitive drum 1 and each of the surface potential and the discharging exposure amount of the photosensitive drum 1 after the post-rotation discharging. FIG. 4 shows a relationship in the case where the discharging exposure amount is made constant at a maximum light quantity of 8 mW. Incidentally, the operating amount of the photosensitive drum 1 is shown by cumulation of the number of sheets subjected to image output on A4-sized recording sheets from the time when the photosensitive drum 1 is unused (hereinafter referred to as "durable sheet (print) number").

When the operating amount (cumulative operating amount) increases from the time when the photosensitive drum 1 is unused, the photosensitive drum 1 becomes poor in sensitivity due to deterioration by the influence of the light and a current, so that a discharging amount is different even depending on the same light quantity. With an increasing operating amount of the photosensitive drum 1, an absolute value of the surface potential of the photosensitive drum 1 after the post-rotation discharging becomes high. This is presumed to be attributable to the following reason. That is, on the photosensitive drum 1, such an operation that light irradiation is made and a current flows is repetitively performed, so that a photo-carrier does not readily generate and the sensitivity becomes poor. As a result, at the same light quantity of the exposure device 3, the absolute value of the surface potential of the photosensitive drum 3 cannot be lowered similarly. This is a phenomenon also called VL up.

From FIG. 4, it is understood that in the case where the discharging exposure amount is made constant, the surface potential of the photosensitive drum 1 after the post-rotation discharging varies depending on the durable sheet number (print number). That is, depending on the durable sheet number, the cases where the absolute value of the surface potential of the photosensitive drum 1 after the post-rotation discharging is lower and larger than a desired value (−110 V in this embodiment) generate.

Figure 17:
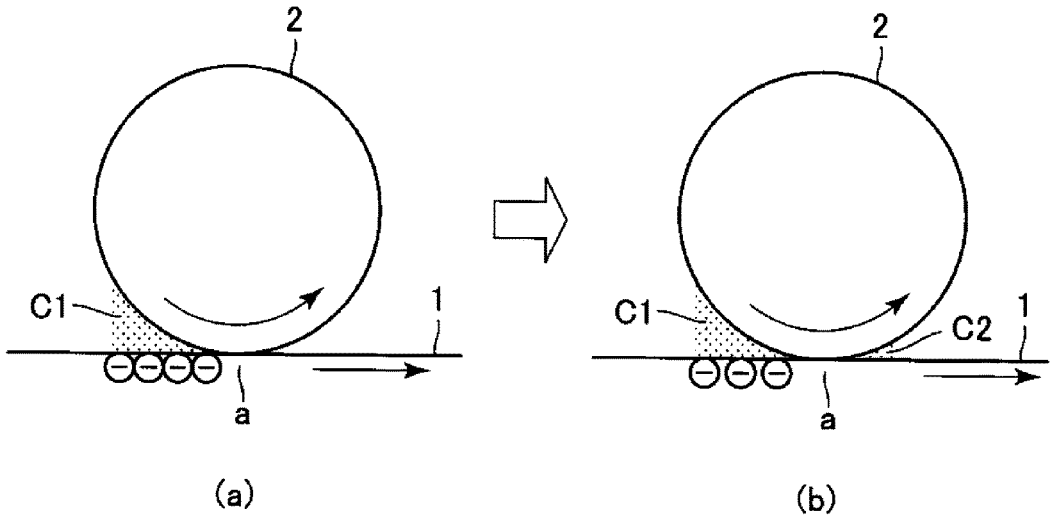
FIG. 17 is a schematic view for illustrating a generation mechanism of a charging lateral stripe.

By study of the present inventor, it was found that when use of the photosensitive drum 1 is continued in such a state that the absolute value of the surface potential after the post-rotation discharging lowers, at a final stage of a lifetime of the photosensitive drum 1, a charging lateral stripe is liable to generate earlier than a predetermined lifetime. This is presumed by the following reason. That is, such a state that the absolute value of the surface potential after the post-rotation discharging lowers, i.e., such a state that the irradiation is made in a discharging exposure amount larger than a necessary amount is continued, a +-side current (positive electric charges) flowing through the photosensitive drum 1 becomes larger than an estimated current as a proper value. By this, although the cause is not necessarily clarified, an electric resistance of the under coat layer 1*b* increases, whereby a speed of movement of a generated photo-carrier toward the cylinder 1*a* lowers. By the increases in electric resistance of such an under coat layer 1*b*, a moving speed of the photo-carrier in the photosensitive drum 1 lowers. As a result, by the influence of the stagnated photo-carrier, a dark decay which is a phenomenon that the absolute value of the surface potential lowers by a lapse of a time from after the photosensitive drum 1 is charged to a predetermined surface potential becomes large. In this way, when the dark decay becomes large, the charging lateral stripe by the above-described mechanism is liable to generate. That is, as shown in (a) of FIG. 17, even when uniform charging of the photosensitive drum 1 is sufficiently completed in the upstream gap C1, a portion thereof passes through the charging nip a, and during movement of the portion thereof toward the downstream gap C2, the absolute value of the surface potential lowers. By this, as shown in (b) of FIG. 17, in the downstream gap C2, incomplete discharging occurs, so that the charging lateral stripe is liable to generate.

On the other hand, when the photosensitive drum 1 is in such a state that the absolute value of the surface potential after the post-rotation discharging becomes high, i.e., a state in which the discharging exposure amount is smaller than the necessary amount, a density fluctuation becomes large so as to an allowable range or more during subsequent image formation in some cases. Of one day, for example, in such a case that images are outputted in a large amount continuously, the density fluctuation due to the increase in image output sheet number is liable to increase to the allowable range or more. This would be considered to be the above-described short period density fluctuation (VL down). That is, in order to suppress the above-described charging lateral stripe at the final stage of the lifetime, for example, in such a constitution that the discharging exposure amount is uniformly made low from an initial stage of use (operation) of the photosensitive drum 1 to the end of the lifetime, this density fluctuation is liable to generate.

Thus, the surface potential of the photosensitive drum 1 after the post-rotation discharging may desirably be maintained at a desired value (in the neighborhood of −100 V in this embodiment) from the initial stage of use to the end of the lifetime. By doing so, the charging lateral stripe as described above and an image defect such as the density fluctuation occurring, for example, during the continuous image formation in one day can be suppressed.

Further, as described above, suppression of the surface potential of the photosensitive drum 1 after the post-rotation discharging to a potential appropriately low in absolute value without making the surface potential substantially completely 0 is effective in terms of suppression of a change in polarity of the photosensitive drum 1 to the opposite polarity after the discharging to discharge the generation of the charging lateral stripe. However, when a state in which the absolute value of the surface potential of the photosensitive drum 1 after the post-rotation discharging is lower than the desired value is continued, due to the increase in dark decay caused by continuation of a state in which the photosensitive drum 1 is excessively discharged, the charging lateral stripe is liable to generate at the final stage of the lifetime of the photosensitive drum 1. However, in order to meet this, when a degree of the discharging is made small with an absolute value, of the surface potential of the photosensitive drum 1 after the post-rotation discharging, higher than the desired value, due to remaining of the photo-carrier, the short period density fluctuation generates in some cases. Accordingly, it is important that the surface potential of the photosensitive drum 1 after the post-rotation discharging is maintained at the desired value from the initial stage of use of the photosensitive drum 1 to the end of the lifetime.

Figure 5:
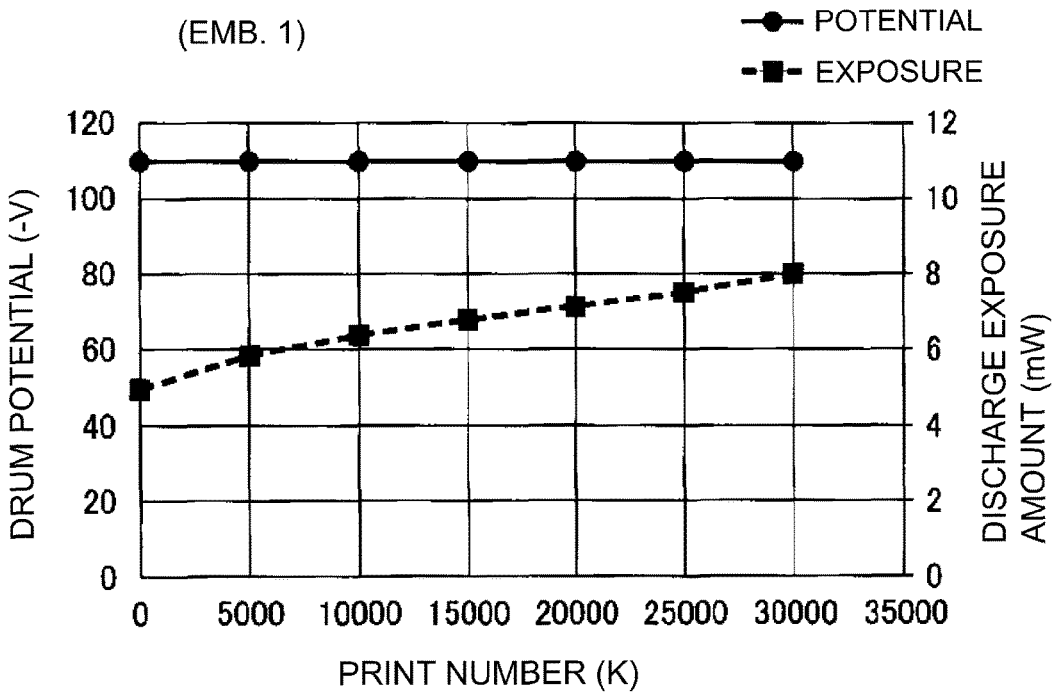
FIG. 5 is a graph showing a relationship between the durable sheet number and each of the surface potential and the discharging exposure amount of the photosensitive drum after the post-rotation discharging in the embodiment of the present invention.

Therefore, in this embodiment, depending on the durable sheet number as the cumulative operating time of the photosensitive drum 1, the light quantity (discharging exposure amount) of the exposure device 3 is applied. FIG. 5 shows a relationship between the cumulative operating amount (durable sheet number) of the photosensitive drum 1 and each of the surface potential and the discharging exposure amount of the photosensitive drum 1 after the post-rotation discharging in this embodiment. In this embodiment, as shown in FIG. 5, control in which the discharging exposure amount is made small at the initial stage of use (operation) of the photosensitive drum 1 and is made larger with an increasing durable sheet number (i.e., with a larger operating amount of the photosensitive drum 1) was effected. In other words, the discharging exposure amount may only be required to be set at a first exposure amount in the case where the operating amount of the photosensitive drum 1 is a first operating amount and may only be required to be set at a second exposure amount larger than the first exposure amount in the case where the operating amount of the photosensitive drum 1 is a second operating amount more than the first operating amount. By this, from the initial stage of use of the photosensitive drum 1 to the end of the lifetime, the surface potential on the photosensitive drum 1 after the post-rotation discharging is maintained substantially constant at a desired voltage of −110 V.

By effecting the control in such a manner, the density fluctuation can be made small and the charging lateral stripe generating at the final stage of the lifetime can be suppressed. Accordingly, when in the case where a relatively simple and inexpensive constitution in which the DC charging type is used and the pre-exposure device is not provided is employed, the discharging of the photosensitive drum 1 is properly performed for a long term, so that a good image can be formed.

3. Control Mode and Control Flow

Figure 6:
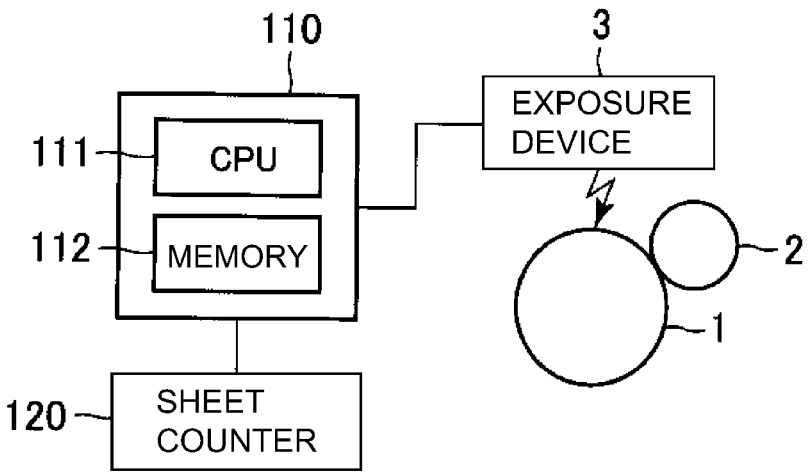
FIG. 6 is a schematic control block diagram of a principal part of the image forming apparatus according to the embodiment of the present invention.

FIG. 6 shows a schematic control mode of a principal part of the image forming apparatus 100 in this embodiment. A control circuit (controller) 110 is constituted by including a CPU 111 as a control means which is a central element for performing computation, a memory (storing medium) 112, such as ROM or RAM, as a storing means, and the like. In the RAM which is a rewritable memory, information inputted into the control circuit 110, detected information, a computation result and the like are stored, and in the ROM, a control program, a data table preliminarily obtained and the like are stored. The CPU 111 and the memory 112 such as the ROM or the RAM are capable of transfer and reading of data from each other.

The control circuit 110 effects centralized control of respective portions of the image forming apparatus 100 to cause the respective portions to perform a sequence operation. Into the control circuit 110, image forming signals (image data, control instruction) and the like are inputted from an external host device (not shown in the figure) such as an image reading device or a personal computer, and the control circuit 110 controls the respective portions of the image forming apparatus 100 in accordance with this, so that an image forming operation is executed. Particularly, in this embodiment, the control circuit 110 is capable of functioning as a control portion for executing the post-rotation discharging (discharging operation) by controlling the exposure device 3 or the like. Further, in this embodiment, the control circuit 110 controls the exposure device 3, an image output sheet number counter 120 and the like and is capable of functioning as an adjusting means for executing an adjusting step of the discharging exposure amount during post-rotation discharging. The image output sheet number counter 120 is constituted by a storing device for integrally and storing the image output sheet number every output of the image. The image output sheet number counter 120 constitutes a detecting means detecting information correlating with the operating amount of the photosensitive drum 1 (or also called an obtaining portion for obtaining information correlating with the cumulative operating time of the photosensitive drum 1). In this embodiment, the control circuit 110 as the adjusting means adjusts the exposure amount by the exposure device 3 during the discharging operation depending on the information correlating with the operating amount of the photosensitive drum 1 (information correlating with the cumulative operating amount of the photosensitive drum 1).

Figure 7:
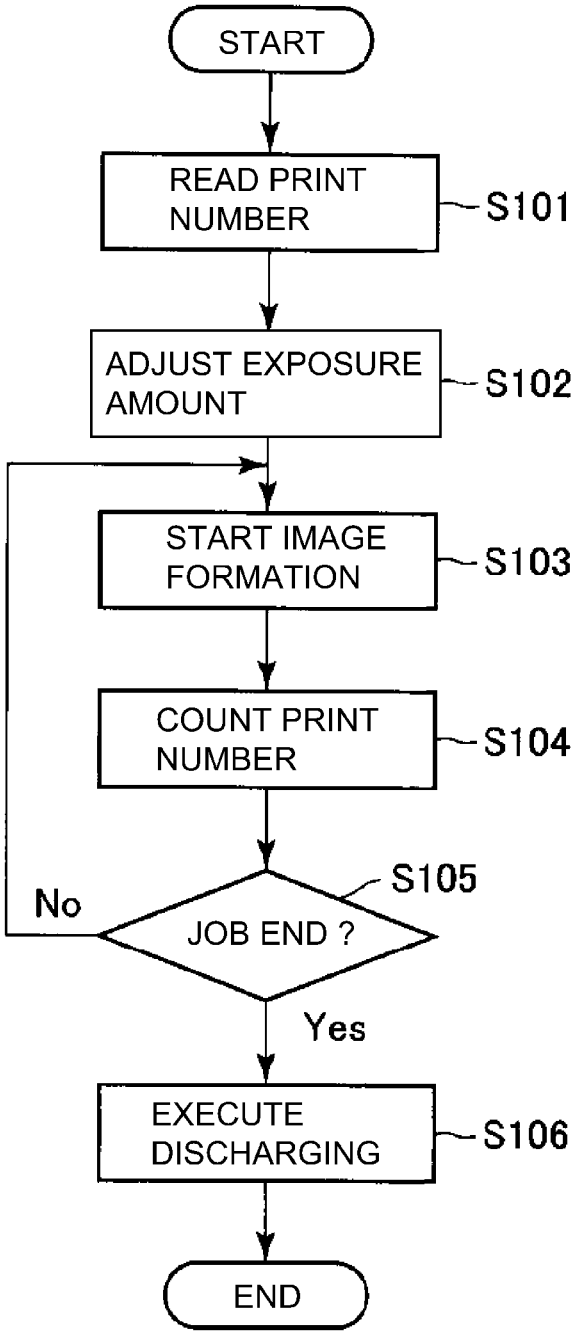
FIG. 7 is a flow chart of an operation of the image forming apparatus in the embodiment of the present invention.

FIG. 7 shows a schematic control flow of an operation of the image forming apparatus 100 including the post-rotation discharging and the adjusting step in this embodiment. In this embodiment, as described above, the adjusting step is executed during the print-preparatory rotation operation (pre-rotation step) as during the non-image formation.

Incidentally, as during the non-image formation in which the adjusting step is capable of being executed, it is possible to cite the following. During the pre-multi-rotation operation in which a predetermined preparatory operation for increasing a fixing temperature during turning-on of a power source for the image forming apparatus, during restoration from a sleep mode, or the like exists. Further, during the above-described print-preparatory rotation operation in which the predetermined preparatory operation is executed from the input of the image forming signals until the image depending on image information is actually written out (formed) exists. Further, during the sheet interval corresponding to a period between recording materials during the continuous image formation exists. Further, during the post-rotation operation in which a predetermined post-operation (preparatory operation) is executed after the image formation is ended exists. Further, the adjusting step may also be performed in parallel during the image formation, for example, in such a manner that the discharging exposure amount during post-rotation discharging is sequentially adjusted during the image formation.

First, the control circuit 110 reads the image output sheet number from the image output sheet number counter 120 (S101). Next, the control circuit 110 sets the discharging exposure amount during post-rotation discharging depending on the read image output sheet number from the relationship between the durable sheet number and the discharging exposure amount as shown in FIG. 5, and stores the set discharging exposure amount in the memory 112 (S102). Incidentally, the above-described relationship between the durable sheet number and the discharging exposure amount is obtained in advance and is stored in the memory 112.

Next, when the predetermined print-preparatory rotation operation is ended, the control circuit 110 starts the image forming operation (S103). Then, every output of the image, the image output sheet number is integrated by the image output sheet number counter 120 (S104). Thereafter, until a job (a series of image forming operations on a single or a plurality of transfer materials by a single image formation start instruction) is ended, the image forming operation and the integration of the image output sheet number counter 120 are repeated (S105).

Next, when the job is ended, the control circuit 110 starts a predetermined post-rotation operation and causes the exposure device 3 to discharge the photosensitive drum 1 during this post-rotation operation (S106). At this time, the light quantity of the exposure device 3 is a discharging exposure amount set in S102. Thereafter, when the predetermined post-rotation operation is ended, the control is ended.

Incidentally, in this embodiment, as an index for detecting the operating amount of the photosensitive drum 1, the image output sheet number was used. However, the present invention is not limited thereto, but it is possible to arbitrarily use information correlating with the value of the photosensitive drum 1, such as a rotation number (rotation time, travelling distance) or an application time of a charging bias, for example.

[Embodiment 2]

Next, another embodiment of the present invention will be described. Basic constitution and operation of an image forming apparatus in this embodiment are the same as those in Embodiment 1. Accordingly, elements having the same or corresponding functions or constitutions as those for the image forming apparatus in Embodiment 1 are represented by the same reference numerals or symbols, and will be omitted from detailed description.

In this embodiment, depending on an environment, the light quantity (discharging exposure amount) of the exposure device 3 during post-rotation discharging is adjusted.

Figure 8:
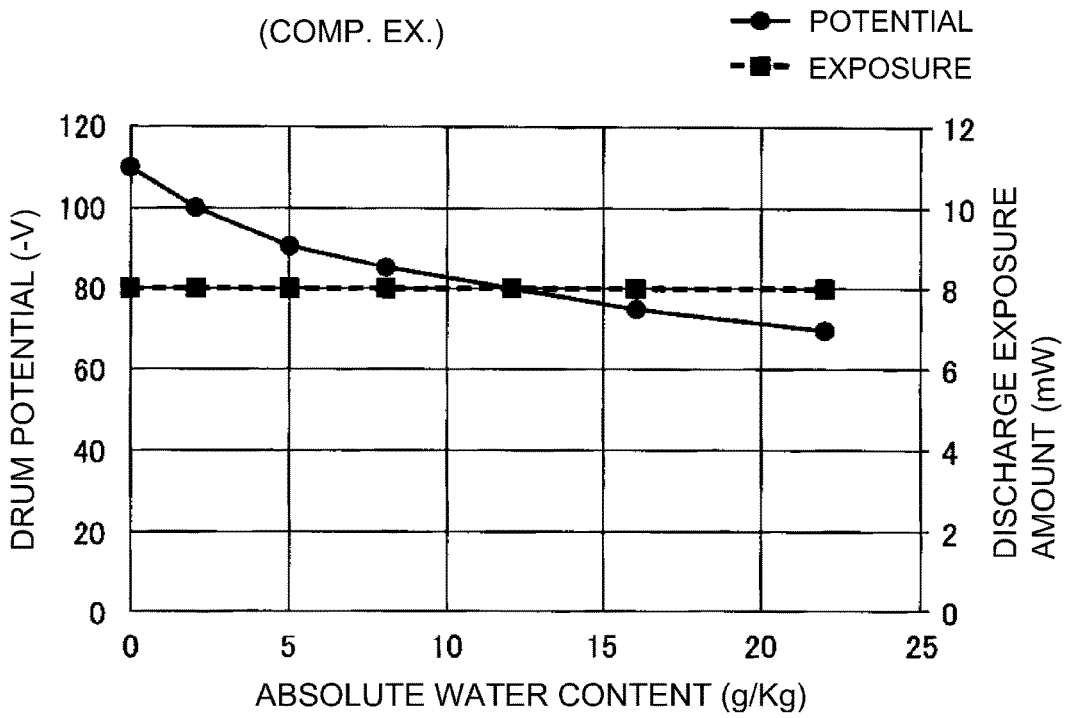
FIG. 8 is a graph showing a relationship between an absolute water content and each of the surface potential and the discharging exposure amount of the photosensitive drum after the post-rotation discharging in the case where the discharging exposure amount during the post-rotation discharging is constant (Comparison Example).

FIG. 8 shows a relationship between an absolute water content in an apparatus main assembly of the image forming apparatus 100 and each of the surface potential and the discharging exposure amount of the photosensitive drum 1 after the post-rotation discharging. FIG. 8 shows a relationship in the case where the discharging exposure amount is made constant at a maximum light quantity of 8 mW. Further, the absolute water content in the apparatus main assembly of the image forming apparatus 100 is calculated from a temperature and a humidity which are detected by an environment sensor (temperature and humidity sensor) provided in the apparatus main assembly.

In the case where the absolute water content is large, for example, in the case of an environment in which the humidity is high, a triboelectric charge amount between the toner and the carrier in the developing device 4 becomes small, so that the toner can be transferred from the developing device 4 onto the photosensitive drum 1 with a small latent image contrast. That is, the potential applied onto the photosensitive drum 1 is small, and therefore the photosensitive drum 1 can be discharged even when the discharging exposure amount during post-rotation discharging is made small.

On the other hand, when the post-rotation discharging is effected at a certain discharging exposure amount irrespective of the absolute water content, as shown in FIG. 8, in an environment in which the absolute water content is small, compared with an environment in which the absolute water content is large, the absolute value of the surface potential of the photosensitive drum 1 after the post-rotation discharging becomes high in some cases. Further, on the other hand, in the environment in which the absolute water content is large, compared with the environment in which the absolute water content is small, the absolute value of the surface potential of the photosensitive drum 1 after the post-rotation discharging becomes low in some cases. In a state in which the surface potential of the photosensitive drum 1 after the post-rotation discharging is different depending on the absolute water content, an amount of the photo-carrier in the photosensitive drum 1 changes, and therefore the charging lateral stripe by endurance as described above and the density fluctuation occurring during the continuous image output, for example, in one day are not constant in some cases. For example, when the use of the photosensitive drum 1 is continued in such a state that the absolute water content is relatively large and the absolute value of the surface potential of the photosensitive drum 1 after the post-rotation discharging is lower than a proper value, at the final stage of the lifetime of the photosensitive drum 1, the charging lateral stripe is liable to generate earlier than a predetermined lifetime in some cases. On the other hand, when the absolute water content is relatively small and the absolute value of the surface potential of the photosensitive drum 1 after the post-rotation discharging is higher than the proper value, the short period density fluctuation generates in some cases.

Figure 9:
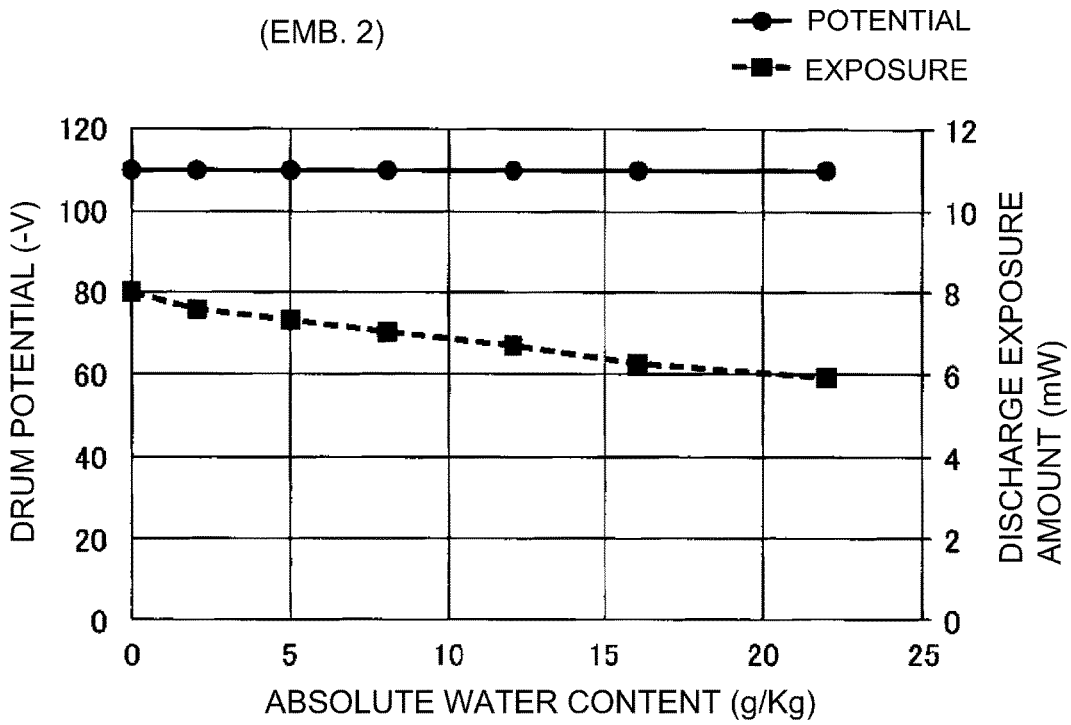
FIG. 9 is a graph showing a relationship between the absolute water content and each of the surface potential and the discharging exposure amount of the photosensitive drum after the post-rotation discharging in another embodiment of the present invention.

Therefore, in this embodiment, depending on the environment absolute water content, the light quantity (discharging exposure amount) of the exposure device 3 during post-rotation discharging is adjusted. FIG. 9 shows a relationship between the absolute water content and each of the surface potential and the discharging exposure amount of the photosensitive drum 1 after the post-rotation discharging in this embodiment. In this embodiment, as shown in FIG. 9, control in which the discharging exposure amount is made smaller with a larger absolute water content was effected. In other words, the discharging exposure amount may only be required to be set at a third exposure amount in the case where the absolute water content is a first water content and may only be required to be set at a fourth exposure amount smaller than the third exposure amount in the case where the absolute water content is a second water content more than the first water content. By this, irrespective of the absolute water content, the surface potential of the photosensitive drum 1 after the post-rotation discharging is made substantially constant at a desired potential of −110 V.

By effecting control in such a manner, the charging lateral stripe and the density fluctuation due to the difference in surface potential of the photosensitive drum 1 after the post-rotation discharging depending on the environment absolute water content can be suppressed. By this, even in the case where the DC charging type is used and a relatively simple and inexpensive constitution in which the pre-exposure device is not provided is employed, irrespective of the environment absolute water content, the discharging of the photosensitive drum 1 is performed properly for a long term, so that a good image can be formed.

Figure 10:
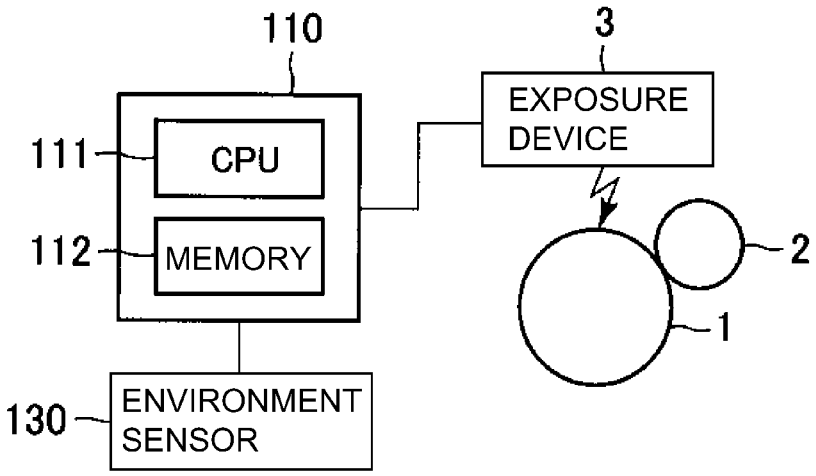
FIG. 10 is a schematic control block of a principal part of an image forming apparatus in the another embodiment of the present invention.

FIG. 10 is a schematic control mode of a principal part of the image forming apparatus 100 in this embodiment. The control mode in this embodiment is similar to the control mode shown in FIG. 6 described in Embodiment 1, but in this embodiment, an environment sensor 130 is provided. The control circuit 110 calculates the absolute water content in the apparatus main assembly of the image forming apparatus 100 from a temperature and a humidity which are detected by the environment sensor 130 provided in the apparatus main assembly of the image forming apparatus 100. The environment sensor 130 and the control circuit 110 constitute a detecting means for detecting environment information. Further, in this embodiment, the control circuit 110 as the adjusting means adjusts the exposure amount by the exposure device 3 during the discharging operation depending on the environment information.

Figure 11:
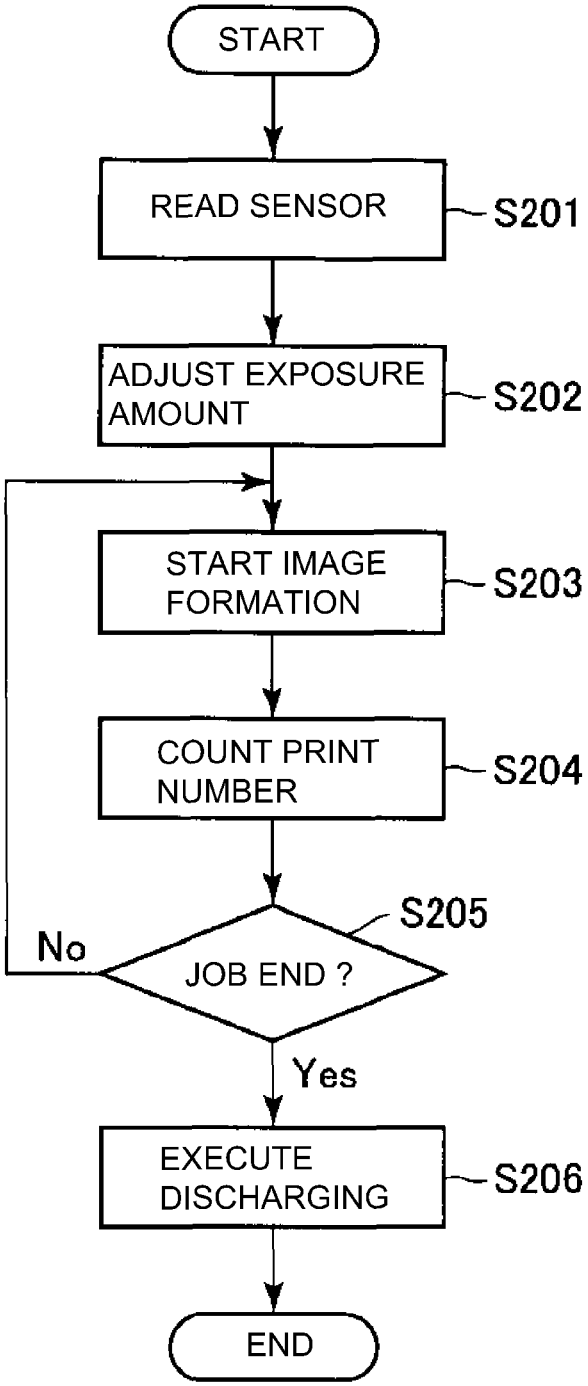
FIG. 11 is a flow chart of an operation of the image forming apparatus in the another embodiment of the present invention.

FIG. 11 shows a schematic control flow of an operation of the image forming apparatus 100 including the post-rotation discharging and the adjusting step in this embodiment. In this embodiment, similarly as in Embodiment 1, the adjusting step is executed during the print-preparatory rotation operation.

First, the control circuit 110 reads the information on the temperature and the humidity from the environment sensor 130 and calculates the absolute water content in the apparatus main assembly of the image forming apparatus 100 (S201). Next, the control circuit 110 sets the discharging exposure amount during post-rotation discharging depending on the calculated absolute water content from the relationship between the absolute water content and the discharging exposure amount as shown in FIG. 9, and stores the set discharging exposure amount in the memory 112 (S202). Incidentally, the above-described relationship between the absolute water content and the discharging exposure amount is obtained in advance and is stored in the memory 112.

Thereafter, processes of S203-S206 are similar to the processes of S103-S106 in FIG. 7 described in Embodiment 1.

Incidentally, in this embodiment, the absolute water content was used as the environment information. However, the present invention is not limited to this, but environment information, having sensitivity to the surface potential of the photosensitive drum 1 after the post-rotation discharging, for example, a temperature, a humidity (relative humidity) or the like may also be arbitrarily used. Further, the environment information is not limited to the environment information in the apparatus main assembly of the image forming apparatus 100, but environment information at a periphery of the image forming apparatus 100 may also be used in addition thereto or in place thereof.

[Embodiment 3]

Next, further embodiment of the present invention will be described. Basic constitution and operation of an image forming apparatus in this embodiment are the same as those in Embodiment 1. Accordingly, elements having the same or corresponding functions or constitutions as those for the image forming apparatus in Embodiment 1 are represented by the same reference numerals or symbols, and will be omitted from detailed description.

In this embodiment, the light quantity (discharging exposure amount) of the exposure device 3 during post-rotation discharging is adjusted depending on a position of the photosensitive drum 1 with respect to a longitudinal direction (thrust direction).

Figure 12:
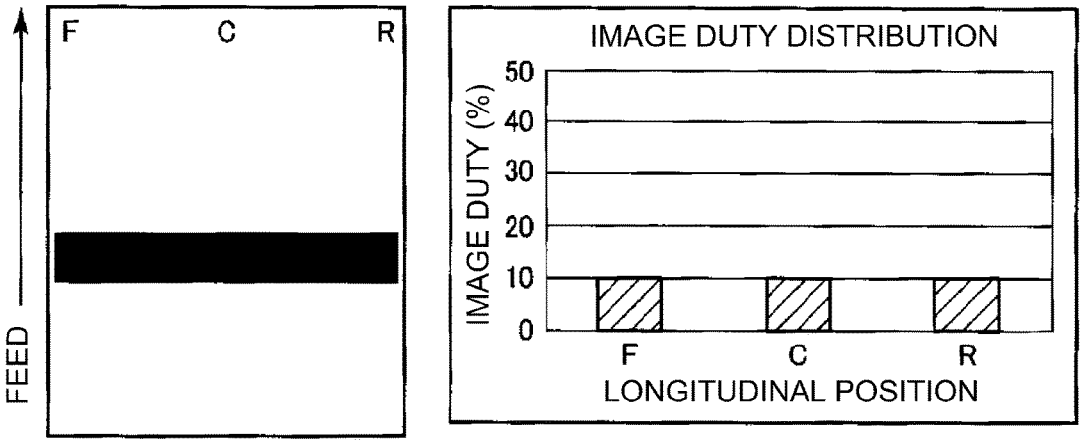
FIG. 12 is a schematic view for illustrating a problem due to a distribution of an image duty with respect to a longitudinal direction of the photosensitive drum.
Figure 13:
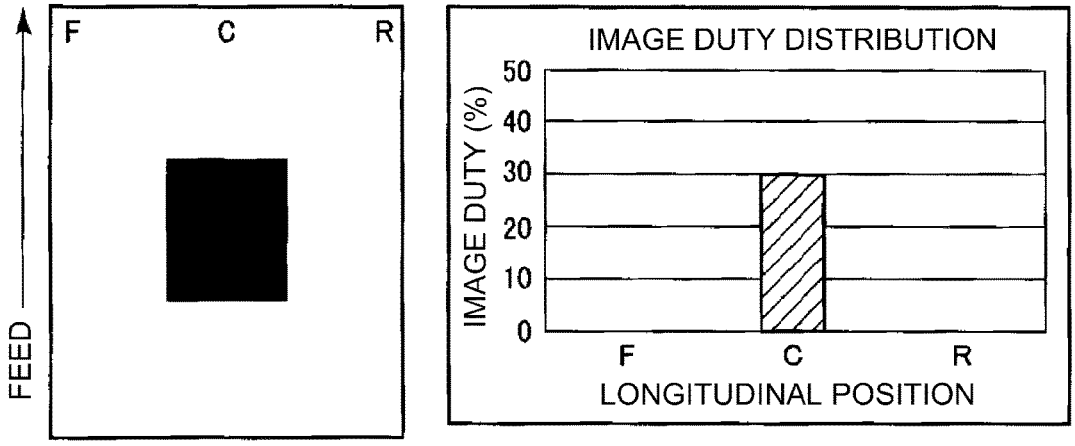
FIG. 13 is a schematic view for illustrating a problem due to a distribution of the image duty with respect to the longitudinal direction of the photosensitive drum.

Referring to FIGS. 12 and 13, a status of generation of the charging lateral stripe and the density fluctuation in the case where each of images different in length of the photosensitive drum 1 with respect to the longitudinal direction are continuously formed will be described. The image formation was effected by feeding the transfer material P having a width of an A4 size (i.e., the transfer material P is fed in the longitudinal direction). Further, images in respective regions of F (front side), C (central portion) and R (rear side) which are obtained by dividing the longitudinal direction of the photosensitive drum 1 into 3 portions as seen from a front surface (corresponding to the front side on the drawing sheet surface of FIG. 1) of the image forming apparatus 100 were evaluated.

FIG. 12 in the case where a stripe-shaped image (lateral stripe) is drawn in a substantially entire region of the photosensitive drum 1 with respect to the longitudinal direction, and an image duty is 10% at F (front side), C (central portion) and R (rear side). On the other hand, FIG. 13 in the case where the image is drawn only at the central portion of the photosensitive drum 1 with respect to the longitudinal direction, and the image duty is 30% only at C (central portion) and is 0% at F (front side) and R (rear side). Incidentally, the image duty is represented by a ratio in the case where an image density is 100% at a maximum density level (solid), and is also referred to as an image ratio, a print ratio or the like.

When the photosensitive drum 1 is continuously exposed to light in order to form the image as shown in FIG. 13, the photosensitive drum 1 is continuously irradiated with the light in a large amount only at the central portion C, where the image duty is high, with respect to the longitudinal direction of the photosensitive drum 1. Further, on the front side F and the rear side R of the photosensitive drum 1 with respect to the longitudinal direction, the image duty is low, and therefore a total amount of light with which the photosensitive drum 1 is irradiated becomes small.

Accordingly, when the image on which the density with respect to the longitudinal direction of the photosensitive drum 1 is localized as shown in FIG. 13 is continuously formed, compared with the case where the image with no localization as shown in FIG. 12 is continuously formed, an amount of a current flowing through the under coat layer 1*b* in the photosensitive drum 1 at a portion where the image duty is high becomes large. By this, at this portion, an electric resistance of the under coat layer 1*b* increases and thus the charging lateral stripe is liable to generate. Further, at a portion where the image duty is low, a total amount of the irradiated light is small, and therefore an amount of the photo-carrier after the post-rotation discharging is small, so that a difference (non-uniformity) in density fluctuation generates in some cases between the portion and the portion where the image duty is high.

Therefore, in this embodiment, a distribution of the exposure amount during the image formation with respect to the longitudinal direction of the photosensitive drum 1 is read, and a distribution of an integrated value of the exposure amount during the image formation with respect to the longitudinal direction of the photosensitive drum 1 is stored. On the basis of the stored information, the exposure amount during post-rotation discharging is adjusted so that a total amount of the integrated exposure amount during the image formation and the exposure amount during post-rotation discharging is a predetermined value. By this, each of the charging lateral stripe and the density fluctuation which are liable to generate depending on a position of the photosensitive drum 1 with respect to the longitudinal direction is suppressed. In the following, description will be made more specifically.

Figure 14:
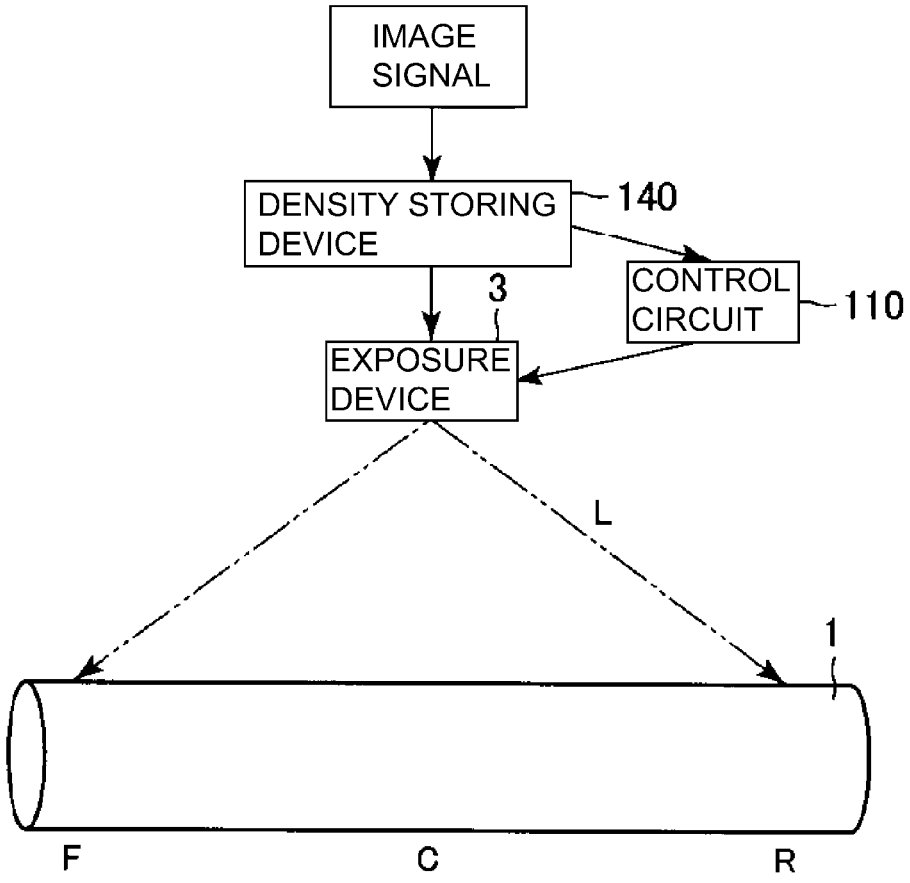
FIG. 14 is a schematic control block diagram of a principal part of an image forming apparatus according to further another embodiment of the present invention.

FIG. 14 shows a schematic control mode of a principal part of the image forming apparatus 100. Similarly as in Embodiment 1, in this embodiment, as the exposure device 3, the laser beam scanner including the semiconductor laser was used. The laser beam scanner outputs the laser light L modulated correspondingly to the image signal inputted from the image reading device (not shown in the figure) or the like. This laser light L is subjected to scanning in the longitudinal direction of the photosensitive drum 1, so that the surface of the photosensitive drum 1 is exposed to the laser light L. At this time, image density information of the image signal at each position of the photosensitive drum 1 with respect to the longitudinal direction is integrated and stored in a density storing device 140. The control circuit 110 obtains an integrated value of the exposure amount of the exposure device 3 during the image formation at each position of the photosensitive drum 1 with respect to the longitudinal direction from the integrated value, of the image density information at each position of the photosensitive drum 1 with respect to the longitudinal direction, stored by the density storing device 140. In this embodiment, the density storing device 140 obtains the integrated value of the image density information every region of a plurality of divided regions with respect to the longitudinal direction of the photosensitive drum 1. Further, in this embodiment, the control circuit 110 obtains an integrated exposure amount, which is an integrated value of the exposure amount of the exposure device 3 during the image formation, every region of the plurality of divided regions with respect to the longitudinal direction of the photosensitive drum 1. Then, the control circuit 110 sets the exposure amount during post-rotation discharging after the image formation so that the sum total of the integrated exposure amount during the image formation in each region and the exposure amount during post-rotation discharging after the image formation is a predetermined value and is substantially equal between the plurality of the regions. The density storing device 140 and the control circuit 110 constitutes a detecting means for detecting the respective exposure amounts in the plurality of the regions with respect to a direction crossing a circumferential direction of the photosensitive drum 1 during formation of the electrostatic image. Further, in this embodiment, the control circuit 110 as the adjusting means adjusts the exposure amount by the exposure device 3 for each of the plurality of the regions depending on the sum of the integrated exposure amount during the electrostatic image formation and the exposure amount during the discharging operation in each of the plurality of the regions.

In this embodiment, for example, an image formable region with respect to the longitudinal direction of the photosensitive drum 1 is divided into 3 regions, and the integrated value of the exposure amount during the image formation in each region is obtained. Further, in this embodiment, the exposure amount device the image formation is integrated every job, and the exposure amount during post-rotation discharging is adjusted during the print-preparatory rotation operation for each job. Incidentally, in this embodiment, the plurality of regions with respect to the longitudinal direction of the photosensitive drum 1 are 3 regions, but are not limited thereto. In view of a desired image quality and complexity of control, any plurality of regions of not more than a resolution of the photosensitive drum 1 with respect to the longitudinal direction can be appropriately used. In either case, an inside of the image formable region with respect to the longitudinal direction of the photosensitive drum 1 may only be required to be divided into a plurality of regions. Further, lengths of the respective regions with respect to the longitudinal direction of the photosensitive drum 1 may be the same or different from each other.

Figure 15:
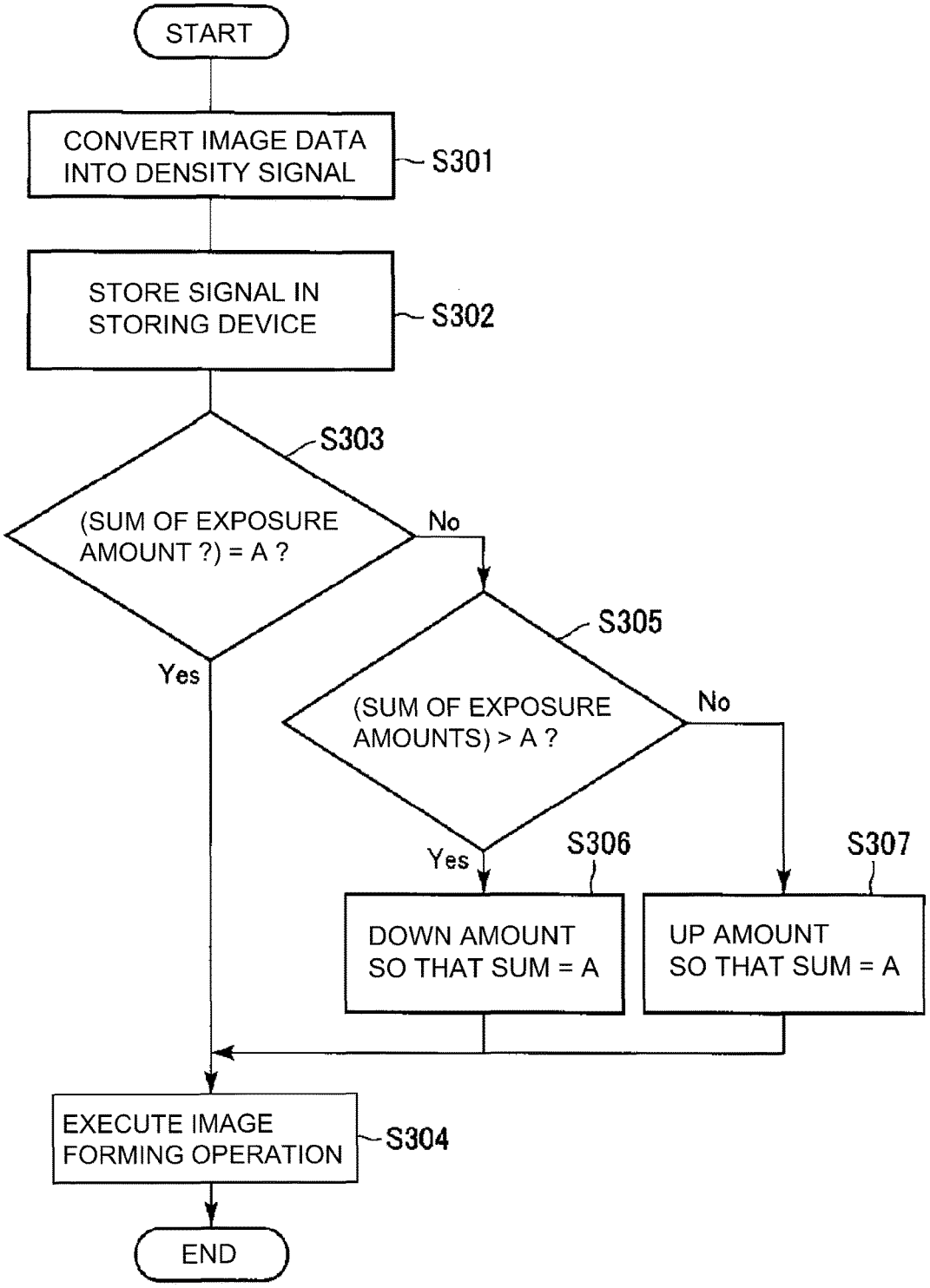
FIG. 15 is a flow chart of an operation of the image forming apparatus in the further another embodiment of the present invention.

FIG. 15 shows a schematic control flow of the operation of the image forming apparatus 100 including the adjusting step in this embodiment.

First, image data inputted into the image forming apparatus 100 is converted into an image density signal in an image processing portion (not shown in the figure) (S301). Next, in the density storing device 140, image density information every certain range with respect to the longitudinal direction of the photosensitive drum 1 is integrated and stored (S302). Next, in the control circuit 110, an exposure amount per unit area during the image formation every certain range with respect to the longitudinal direction of the photosensitive drum 1 is obtained, and whether or not the sum total of this exposure amount per unit area and an exposure amount per unit area during post-rotation discharging is a predetermined value A is discriminated (S303). The exposure amount, during post-rotation discharging, used at this time is the exposure amount during the last post-rotation discharging for each region. Setting of the discharging exposure amount during post-rotation discharging is stored in the memory 112.

In S303, in the case where the above-mentioned sum total in each region with respect to the longitudinal direction of the photosensitive drum 1 is substantially equal to the predetermined value A, the control circuit 110 does not change the exposure amount during post-rotation discharging, but executes the image forming operation (S304).

In S303, in the case where in each region with respect to the longitudinal direction of the photosensitive drum 1, the region in which the sum total is not substantially equal to the predetermined value A exists, the control circuit 110 discriminates whether or not the sum total is larger than the predetermined value A in the region in which the sum total is not substantially equal to the predetermined value A (S305). Then, in the case of a large, the control circuit 110 controls the exposure amount during post-rotation discharging so as to be small so that the sum total of the exposure amounts in the region is the predetermined value A (S306). Incidentally, in a region in which the sum total is substantially equal to the predetermined value A, the exposure amount during post-rotation discharging is not changed.

Further, in S305, in the case where the sum total in the region in which the sum total is not substantially equal to the predetermined value A is smaller than the predetermined value A, the control circuit 110 controls the exposure amount during post-rotation discharging so as to be large so that the sum total of the exposure amounts in the region is the predetermined value A (S307). Incidentally, in the region in which the sum total is substantially equal to the predetermined value A, the exposure amount during post-rotation discharging is not changed.

The control circuit 110 executes the image forming operation after the setting of the exposure amount during post-rotation discharging is changed in 306 and S307 (S304). Then, the control circuit 110 executes the post-rotation discharging at the exposure amount set every region with respect to the longitudinal direction of the photosensitive drum 1 in the above-described manner during the post-rotation operation after the image forming operation (job) is ended.

Figure 16:
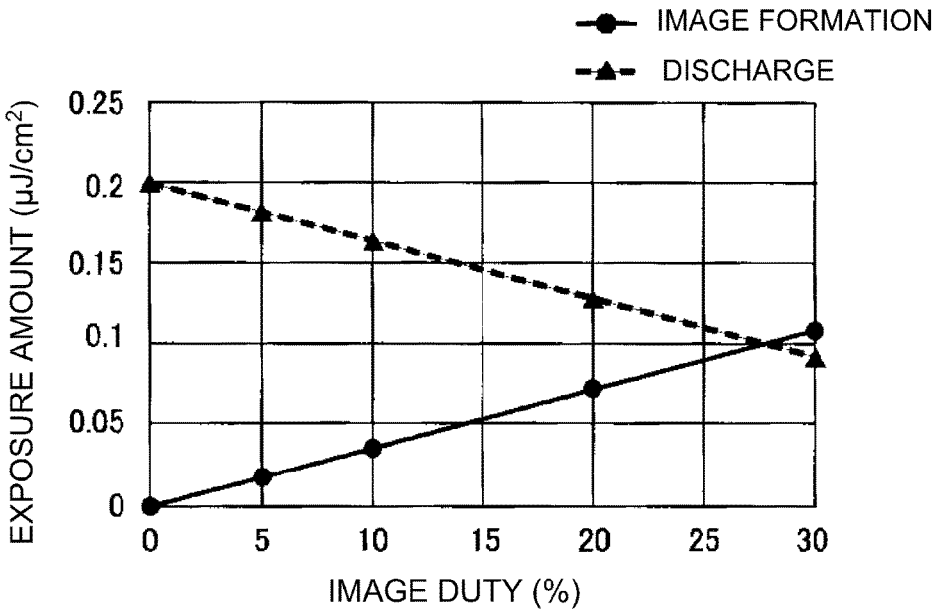
FIG. 16 is a graph showing a relationship between an image duty and each of exposure amounts during image formation and during post-rotation discharging in the further another embodiment of the present invention.

FIG. 16 shows a relationship between the image duty and each of the exposure amounts during image formation and during post-rotation discharging in the case where the predetermined value A of the sum total of the above-described exposure amounts is 0.2 ($\mu J/cm^2$). The abscissa shows the image duty of the image signal, and the ordinate shows the exposure amount ($\mu J/cm^2$) of the laser light irradiated on the photosensitive drum 1.

At the portion where the image duty is small with respect to the longitudinal direction of the photosensitive drum 1, for example at a portion where the image duty is 0%, the exposure amount during post-rotation discharging is set at 0.2 ($\mu J/cm^2$). On the other hand, with respect to the longitudinal direction of the photosensitive drum 1, at the portion where the image duty is large, for example at a portion where the image duty is 28%, the exposure amount during image formation is 0.1 ($\mu J/cm^2$), and therefore the exposure amount during post-rotation discharging is set at 0.1 ($\mu J/cm^2$) so that the sum total is 0.2 ($\mu J/cm^2$).

That is, in the case of an image on which the density is localized with respect to the longitudinal direction of the photosensitive drum 1, for example in the case of the image signal as shown in FIG. 13, the exposure device 3 is controlled so that the exposure amount during post-rotation discharging is made small at the central portion with respect to the longitudinal direction of the photosensitive drum 1 and is made large at both end portion with respect to the longitudinal direction of the photosensitive drum 1.

By effecting control in such a manner, even in the case where the image density is localized with respect to the longitudinal direction of the photosensitive drum 1, a lifetime of the photosensitive drum 1 can be made substantially constant with respect to the longitudinal direction, and therefore it is possible to suppress that the charging lateral stripe is liable to generate locally. Further, even in the case where the image density is localized with respect to the longitudinal direction of the photosensitive drum 1, it is possible to suppress that the discharging becomes insufficient after the post-rotation discharging and thus the non-uniformity of the density fluctuation generates.

(Other Embodiments)

In the above, the present invention was described in accordance with specific embodiments, but the present invention is not limited to the above-described embodiments.

In the above-described embodiments, as the exposure device 3, the laser beam scanner including the semiconductor laser was used, but for example, another exposure device including LED or the like may also be used.

Further, Embodiments 1-3 may also be carried out by combining all or some thereof. For example, the adjustment of the exposure amount during post-rotation discharging depending on the durable sheet number described in Embodiment 1 and the adjustment of the exposure amount during post-rotation discharging depending on the environment described in Embodiment 2 may also be used in combination. In this case, the relationship between the absolute water content and the discharging exposure amount as shown in FIG. 9 is obtained every durable sheet number in advance or the discharging exposure amount obtained from the relationship between the durable sheet number and the discharging exposure amount as shown in FIG. 5 is corrected by the absolute water content, so that the discharging exposure amount can be obtained. For example, with a larger absolute water content, the discharging exposure amount obtained for each of the durable sheet numbers can be corrected in a decreasing direction. Further, the adjustment of the exposure amount during post-rotation discharging depending on the durable sheet number described in Embodiment 1 and the adjustment of the exposure amount during post-rotation discharging depending on the position of the photosensitive drum 1 with respect to the longitudinal direction described in Embodiment 3 may also be used in combination. In this case, with an increasing durable sheet number, the predetermined value A of the sum total of the exposure amounts described in Embodiment 3 can be controlled so as to become large.

Further, the present invention is also naturally possible to be applied to a color image forming apparatus. For example, a color image forming apparatus in which a plurality of image forming portions as shown in FIG. 1 are provided and toner images different in color formed at the respective image forming portions are transferred onto an intermediary transfer member and thereafter are transferred onto the transfer material carried on a transfer material carrying member and thus a color image is formed is well known. In this case, in relation to photosensitive members of the respective image forming portions, it is possible to effect control similar to pieces of control in the above-described respective embodiments. By this, it is possible to form a high-quality color image or the like by uniform charging. Moreover, even in the case where a relatively simple and inexpensive constitution in which the DC charging type is used and the pre-exposure device is not provided is employed, this can be realized.

INDUSTRIAL APPLICABILITY

According to the present invention, there is provided an image forming apparatus capable of suppressing the charging lateral stripe liable to generate at the final stage of the photosensitive member while suppressing the density fluctuation.

EXPLANATION OF SYMBOLS

1 Photosensitive drum
2 Charging roller
3 Exposure device
4 Developing device
110 Control circuit
120 Image output sheet number counter
130 Environment sensor
140 Density storing device

The invention claimed is:

1. An image forming apparatus comprising:

a rotatable photosensitive member;

a charging portion, rotatably contacting said photosensitive member, configured to electrically charge said photosensitive member by electric discharge under application of a DC voltage;

a charging voltage source configured to apply the DC voltage to said charging portion;

an exposure portion configured to expose said photosensitive member charged by said charging portion to light to form an electrostatic image on a surface of said photosensitive member;

a developing portion configured to develop, with a toner, the electrostatic image formed on the surface of said photosensitive member by said exposure portion to form a toner image on the surface of said photosensitive member;

a transfer device configured to transfer the toner image formed on the surface of said photosensitive member onto a transfer material at a transfer portion, wherein image formation is effected without the exposure of said photosensitive drum to light in a position downstream of the transfer portion and upstream of said charging portion with respect to a rotational direction of said photosensitive member;

an obtaining portion configured to obtain information relating to a cumulative operating time of said photosensitive member;

an environment sensor configured to obtain information relating to water content of environment; and a controller configured to effect control so that the surface of said photosensitive member is exposed to light by said exposure portion over not less than one full turn of said photosensitive member during post-rotation after completion of formation of a final electrostatic image and before stop of rotation of said photosensitive member in a period of successive rotation of said photosensitive member, on the basis of the information obtained by said obtaining portion and the information obtained by said environment sensor, wherein said controller effects control during the post-rotation so that, (a) when the cumulative operating time obtained by said obtaining portion is a first time, an exposure amount of said photosensitive member by said exposure portion is a first exposure amount, and when the cumulative operating time obtained by said obtaining portion is a second time longer than the first time, the exposure amount is a second exposure amount larger than the first exposure amount, and (b) when the water content obtained by said environment sensor is a first water content, the exposure amount by said exposure portion is a third exposure amount, and when the water content obtained by said environment sensor is a second water content more than the first water content, the exposure amount is a fourth exposure amount smaller than the third exposure amount.

2. An image forming apparatus according to claim 1, wherein said controller controls the exposure amount of said photosensitive member by said exposure portion so that a potential of said photosensitive member, after exposure by said exposure portion, during post-rotation is a predetermined value.

3. An image forming apparatus according to claim 1, wherein the information relating to the cumulative operating time is any one of a number of sheets subjected to the image formation, a cumulative rotation time of said photosensitive member and a cumulative time in which the DC voltage is applied to said charging portion.

4. An image forming apparatus according to claim 1, wherein the water content of environment is based on at least one of a temperature and a humidity in the environment and includes either one of a relative humidity and an absolute water content.

* * * * *